US011630400B2

(12) United States Patent
Shimizu et al.

(10) Patent No.: US 11,630,400 B2
(45) Date of Patent: Apr. 18, 2023

(54) IMAGE FORMING APPARATUS

(71) Applicant: KYOCERA Document Solutions Inc., Osaka (JP)

(72) Inventors: Tamotsu Shimizu, Osaka (JP); Yoshihiro Yamagishi, Osaka (JP); Kazunori Tanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/812,097

(22) Filed: Jul. 12, 2022

(65) Prior Publication Data

US 2023/0019917 A1 Jan. 19, 2023

(30) Foreign Application Priority Data

Jul. 13, 2021 (JP) ..... JP2021-115728

(51) Int. Cl.
*G03G 15/00* (2006.01)
*G03G 15/06* (2006.01)

(52) U.S. Cl.
CPC ..... *G03G 15/065* (2013.01); *G03G 15/5037* (2013.01)

(58) Field of Classification Search
CPC ... G03G 15/00; G03G 15/065; G03G 15/5037
USPC ..... 399/38, 42, 46, 48
See application file for complete search history.

(56) References Cited

U.S. PATENT DOCUMENTS 7,379,682 B2 * 5/2008 Campbell ..... G03G 15/5062 399/49

FOREIGN PATENT DOCUMENTS

JP H09-138581 A 5/1997

* cited by examiner

*Primary Examiner* — Hoan H Tran
(74) *Attorney, Agent, or Firm* — Studebaker & Brackett PC

(57) ABSTRACT

An image forming apparatus includes image forming units. A controller includes an execution section, a measurement section, and a prediction section. The execution section controls execution of a developer refresh operation in which toner is ejected from a developer bearing member to an image bearing member so that a specific image forming unit replenishes a development device with the toner from the developer bearing member. The measurement section measures respective surface potentials of the image bearing members included in other image forming units while the specific image forming unit is executing the developer refresh operation. The prediction section uses measurement results of the respective surface potentials of the image bearing members included in the other image forming units for a prediction on the surface potential of the image bearing member included in the specific image forming unit.

3 Claims, 5 Drawing Sheets

| | 0 sheets | 10K sheets | 20K sheets | 27K sheets |
|---|---|---|---|---|
| K | 230 | 230 | 231 | 230 |
| C | 232 | 232 | 232 | 233 |
| M | 231 | 230 | 229 | 230 |
| Y | 230 | 230 | 232 | Developer refresh mode |
| 4 color average | 230.8 | 230.5 | 231.0 | |
| KCM average | 231.0 | 230.7 | 230.7 | 231.0 |

IMAGE FORMING APPARATUS

INCORPORATION BY REFERENCE

The present application claims priority under 35 U.S.C. § 119 to Japanese Patent Application No. 2021-115728, filed on Jul. 13, 2021. The contents of this application are incorporated herein by reference in their entirety.

BACKGROUND

The present disclosure relates to an image forming apparatus.

An image forming apparatus detects a development current at the time of development with respect to a reference document, and calculates a corrected surface potential of a photosensitive drum (image bearing member) from ROM (read-only memory) data according to the detected development current.

SUMMARY

An image forming apparatus according to an aspect of the present disclosure includes a plurality of image forming units, a toner replenishing section, and a controller. The toner replenishing section replenishes each of the plurality of image forming units with toner. The controller controls an operation of the toner replenishing section and the plurality of image forming units. Each of the plurality of image forming units has an image bearing member, a development device, and a development power supply section. The image bearing member bears an electrostatic latent image. The development device includes a developer bearing member that bears a developer containing the toner, and attaches the toner to the electrostatic latent image borne on the image bearing member to form a toner image. The development power supply section applies a bias voltage across the developer bearing member. The controller includes an execution section, a measurement section, and a prediction section. The execution section controls execution of a developer refresh operation in which the toner is ejected from the developer bearing member to the image bearing member so that a specific image forming unit of the plurality of image forming units replenishes the development device with the toner from the developer bearing member. The measurement section measures a surface potential of the image bearing member in each of other image forming units other than the specific image forming unit of the plurality of image forming units while the developer refresh operation is being executed in the specific image forming unit. The prediction section uses a measurement result of the surface potential of the image bearing member of each of the other image forming units for a prediction on the surface potential of the image bearing member of the specific image forming unit.

DETAILED DESCRIPTION

Figure 1:
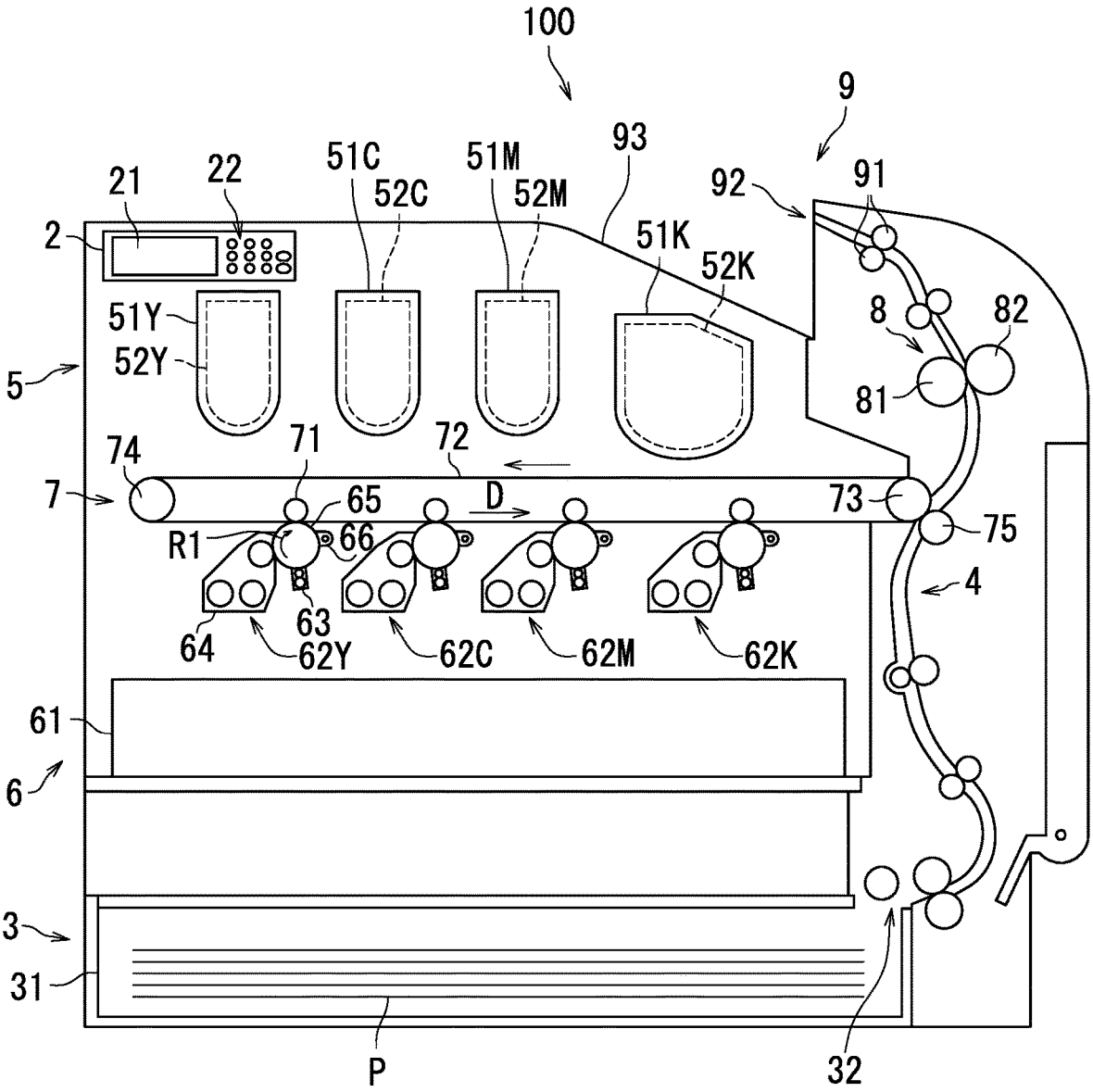
FIG. 1 is a schematic cross-sectional view illustrating an example of an image forming apparatus according to an embodiment.

An embodiment of the present disclosure will hereinafter be described with reference to the accompanying drawings. Note that elements which are the same or equivalent are labelled the same reference signs in the drawings and description thereof is not repeated.

A configuration of an image forming apparatus 100 according to an embodiment of the present disclosure will be described with reference to FIG. 1. FIG. 1 is a schematic cross-sectional view illustrating an example of the image forming apparatus 100. The image forming apparatus 100 is, for example a tandem color printer.

As illustrated in FIG. 1, the image forming apparatus 100 includes an operation section 2, a sheet feed section 3, a conveyance section 4, a toner replenishing section 5, an image forming section 6, a transfer section 7, a fixing section 8, and an ejection section 9.

The operation section 2 receives an instruction from a user. The operation section 2 includes a liquid crystal display 21 and a plurality of operation keys 22. The liquid crystal display 21 displays, for example various processing results. The operation keys 22 include, for example a numeric keypad and a start key.

The sheet feed section 3 has a paper feed cassette 31 and a paper feed roller group 32. The sheet feed section 3 includes a sheet feed cassette 31 and sheet feed rollers 32. The sheet feed cassette 31 is allowed to accommodate a plurality of sheets P. The sheet feed rollers 32 feed the papers P stored in the sheet feed cassette 31 one by one to the conveyance section 4.

The conveyance section 4 includes rollers and guide members. The conveyance section 4 extends from the sheet feed section 3 to the ejection section 9. The conveyance section 4 conveys a paper P from the sheet feed section 3 to the ejection section 9 via the image forming section 6 and the fixing section 8.

The toner replenishing section 5 replenishes the image forming section 6 with toner. The toner replenishing section 5 includes a first mounting section 51Y, a second mounting section 51C, a third mounting section 51M, and a fourth mounting section 51K.

A first toner container 52Y is mounted on the first mounting section 51Y. Similarly, a second toner container 52C is mounted on the second mounting section 51C, a third toner container 52M is mounted on the third mounting section 51M, and a fourth toner container 52K is mounted on the fourth mounting section 51K. The configurations of the first mounting section 51Y to the fourth mounting section 51K are the same except for the types of the toner containers to be mounted.

Toner is stored in each of the first toner container 52Y to the fourth toner container 52K. In the present embodiment, yellow toner is stored in the first toner container 52Y. Cyan toner is stored in the second mounting section 52C. Magenta toner is stored in the third toner container 52M. Black toner is stored in the fourth toner container 52K.

The image forming section 6 includes a light exposure device 61, a first image forming unit 62Y, a second image forming unit 62C, a third image forming unit 62M, and a fourth image forming unit 62K.

Each of the first image forming unit 62Y to the fourth image forming unit 62K includes a charging device 63, a development device 64, a photosensitive drum 65, and a cleaning device 66. The photosensitive drum 65 corresponds to an example of an "image bearing member".

The charging device 63, the development device 64, and the cleaning device 66 are arranged along the peripheral surface of the photosensitive drum 65. In the present embodiment, the photosensitive drum 65 rotates in the direction (clockwise) indicated by the arrow R1 in FIG. 1.

The charging device 63 uniformly charges the photosensitive drum 65 to a predetermined polarity by electric discharge. In the present embodiment, the charging device 63 charges the photosensitive drum 65 to a positive polarity. The light exposure device 61 directs laser light onto the charged photosensitive drum 65. As a result, an electrostatic latent image is formed on the surface of the photosensitive drum 65.

The development device 64 develops the electrostatic latent image formed on the surface of the photosensitive drum 65 to form a toner image. The development device 64 is replenished with toner from the toner replenishing section 5. The development device 64 supplies the surface of the photosensitive drum 65 with the toner replenished from the toner replenishing section 5. As a result, a toner image is formed on the surface of the photosensitive drum 65.

In the present embodiment, the development device 64 included in the first image forming unit 62Y is connected with the first mounting section 51Y. Therefore, the development device 64 included in the first image forming unit 62Y is replenished with the yellow toner. Accordingly, a yellow toner image is formed on the surface of the photosensitive drum 65 included in the first image forming unit 62Y.

The development device 64 included in the second image forming unit 62C is connected with the second mounting section 51C. Therefore, the development device 64 included in the second image forming unit 62C is replenished with the cyan toner. Accordingly, a cyan toner image is formed on the surface of the photosensitive drum 65 included in the second image forming unit 62C.

The development device 64 included in the third image forming unit 62M is connected with the third mounting section 51M. Therefore, the development device 64 included in the third image forming unit 62M is replenished with the magenta toner. Accordingly, a magenta toner image is formed on the surface of the photosensitive drum 65 included in the third image forming unit 62M.

The development device 64 included in the fourth image forming unit 62K is connected to the fourth mounting section 51K. Therefore, the development device 64 included in the fourth image forming unit 62K is replenished with the black toner. Accordingly, a black toner image is formed on the surface of the photosensitive drum 65 included in the fourth image forming unit 62K.

The transfer section 7 superposes and transfers, on the sheet P, the toner images formed on the surfaces of the photosensitive drums 65 included in the first image forming unit 62Y to the fourth image forming unit 62K. In the present embodiment, the transfer section 7 superposes and transfers the toner images on the sheet P by a secondary transfer method. Specifically, the transfer section 7 has four primary transfer rollers 71, an intermediate transfer belt 72, a drive roller 73, a driven roller 74, and a secondary transfer roller 75.

The intermediate transfer belt 72 is an endless belt stretched on the four primary transfer rollers 71, the drive roller 73, and the driven roller 74. The intermediate transfer belt 72 is driven according to the rotation of the drive roller 73. In FIG. 1, the intermediate transfer belt 72 orbits counterclockwise. The driven roller 74 is driven in a rotational manner in response to the drive of the intermediate transfer belt 72.

The first image forming unit 62Y to the fourth image forming unit 62K are positioned opposite the lower surface of the intermediate transfer belt 72 in the driving direction D of the lower surface of the intermediate transfer belt 72. In the present embodiment, the first image forming unit 62Y to the fourth image forming unit 62K are arranged from the upstream side to the downstream side in the driving direction D of the lower surface of the intermediate transfer belt 72 in the order of the first image forming unit 62Y to the fourth image forming unit 62K.

The primary transfer rollers 71 are positioned opposite the photosensitive drums 65 through the intermediate transfer belt 42, and pressed against the photosensitive drums 65. Therefore, the toner images formed on the surfaces of the photosensitive drums 65 are sequentially transferred on the intermediate transfer belt 72.

The cleaning device 66 removes residual toner on the surface of the photosensitive drum 65.

In the present embodiment, the yellow toner image, the cyan toner image, the magenta toner image, and the black toner image are superposed and transferred on the intermediate transfer belt 72 in this order. Hereinafter, the toner image in which the yellow toner image, the cyan toner image, the magenta toner image, and the black toner image are superposed is referred to as a "superposed toner image".

The secondary transfer roller 75 is positioned opposite the drive roller 73 through the intermediate transfer belt 72. The secondary transfer roller 75 is pressed against the drive roller 73. As a result, a transfer nip is formed between the secondary transfer roller 75 and the drive roller 73. When the sheet P passes through the transfer nip, the superposed toner image on the intermediate transfer belt 72 is transferred on the sheet P. The sheet P on which the superposed toner image is transferred is conveyed toward the fixing section 8 by the conveyance section 4.

The fixing section 8 includes a heating member 81 and a pressure member 82. The heating member 81 and the pressurizing member 82 are opposite each other and form a fixing nip. The sheet P conveyed from the image forming section 6 passes through the fixing nip with pressure and heat at a predetermined fixing temperature receiving from the fixing nip. As a result, the superposed toner image is fixed on the sheet P. The sheet P is conveyed from the fixing section 8 to the ejection section 9 by the conveyance section 4.

The ejection section 9 has an ejection roller pair 91 and an exit tray 93. The ejection roller pair 91 conveys the sheet P to the exit tray 93 through the exit port 92. The exit port 92 is formed on the upper part of the image forming apparatus 100.

Figure 2:
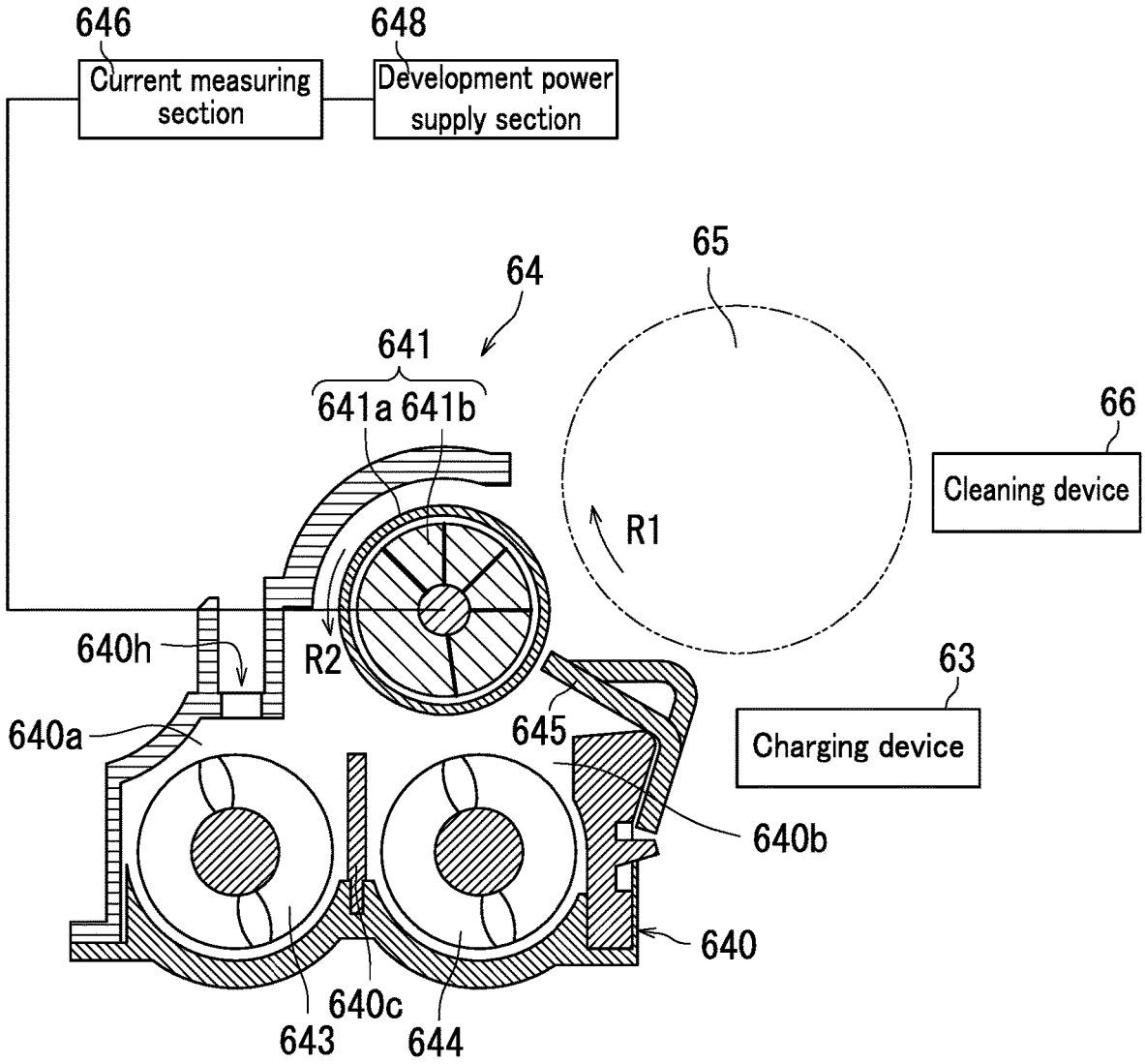
FIG. 2 is an enlarged cross-sectional view illustrating an example of a specific configuration of a development device.

Next, the specific configuration of the development device 64 will be described with reference to FIGS. 1 and 2. FIG. 2 is an enlarged cross-sectional view illustrating an example of the specific configuration of the development device 64. In FIG. 2, the photosensitive drum 65 is illustrated by a two-dot chain line for easy understanding.

As illustrated in FIG. 2, the development device 64 includes, inside a developer container 640, a development roller 641, a first stirring screw 643, a second stirring screw 644, and a blade 645. Specifically, the development roller 641 is positioned opposite the second stirring screw 644. The blade 645 is positioned opposite the development roller 641.

The developer container 640 is partitioned into a first stirring chamber 640*a* and a second stirring chamber 640*b* by a partition wall 640*c*. The partition wall 640*c* extends in the axial direction of the development roller 641. The first stirring chamber 640*a* and the second stirring chamber 640*b* communicate with each other outside both ends in the longitudinal direction of the partition wall 640*c*.

The first stirring screw 643 is placed in the first stirring chamber 640*a*. Carriers of magnetic materials are stored in the first stirring chamber 640*a*. The first stirring chamber 640*a* is replenished with non-magnetic toner through a toner replenishment port 640*h*.

A second stirring screw 644 is placed in the second stirring chamber 640*b*. Carriers of magnetic materials are stored in the second stirring chamber 640*b*.

The toner is stirred by the first stirring screw 643 and the second stirring screw 644 and mixed with the carriers. As a result, dual component developer is composed of the carriers and the toner.

The first stirring screw 643 and the second stirring screw 644 circulate and stir the developer between the first stirring chamber 640*a* and the second stirring chamber 640*b*. As a result, the toner is charged to a predetermined polarity. In the present embodiment, the toner is charged to a positive polarity.

The development roller 641 includes a non-magnetic rotary sleeve 641*a* and a magnet body 641*b*. The magnet body 641*b* is placed and fixed inside the rotary sleeve 641*a*. The magnet body 641*b* includes a plurality of magnetic poles. The developer is attracted to the development roller 641 by the magnetic force of the magnet body 641*b*. As a result, a magnetic brush is formed on the surface of the development roller 641. The development roller 641 corresponds to an example of a "developer bearing member".

In the present embodiment, the development roller 641 rotates in the direction indicated by the arrow R2 (counterclockwise) in FIG. 2. The development roller 641 rotates to convey the magnetic brush to a position facing the blade 645. The blade 645 is positioned to form a gap together with the development roller 641. Therefore, the thickness of the magnetic brush is defined by the blade 645. The blade 645 is placed upstream of the facing position of the development roller 641 and the photosensitive drum 65, in the rotational direction of the development roller 641.

The magnetic brush formed on the surface of the development roller 641 is conveyed to a position facing the photosensitive drum 65. As a result, the development device 64 adheres the toner to the electrostatic latent image supported on the photosensitive drum 65 to form the toner image.

The development device 64 further includes a development power supply section 648 and a current measuring section 646.

The development power supply section 648 applies a predetermined bias voltage across the development roller 641. The bias voltage includes, for example a DC component and an AC component. The current measuring section 646 is connected between the development power supply section 648 and the development roller 641 and measures a development current flowing between the development roller 641 and the photosensitive drum 65.

Figure 3:
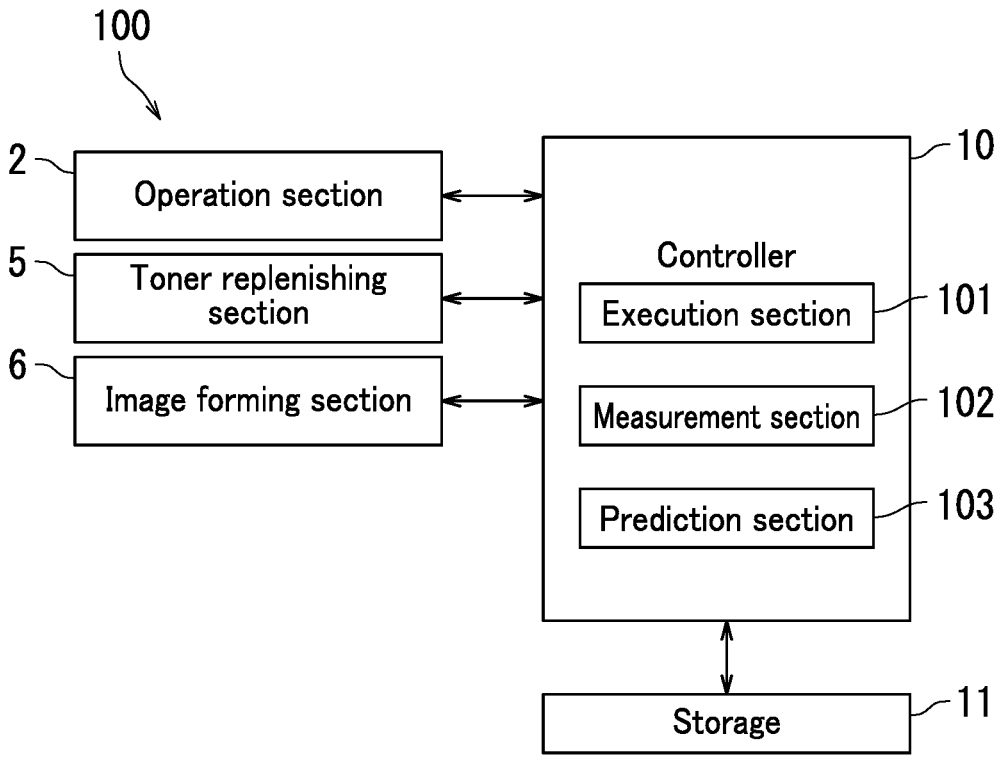
FIG. 3 is a block diagram illustrating an example of a circuit configuration of the image forming apparatus.

Next, the circuit configuration of the image forming apparatus 100 will be described with reference to FIGS. 1 to 3. FIG. 3 is a block diagram illustrating an example of a circuit configuration of the image forming apparatus 100.

As illustrated in FIG. 3, the image forming apparatus 100 further includes a controller 10 and storage 11.

The storage 11 includes a storage device and stores data and a computer program. The storage 11 includes a main storage device such as a semiconductor memory and an auxiliary storage device such as a hard disk drive.

The controller 10 includes a processor such as a central processing unit (CPU), and executes the computer program stored in the storage 11, thereby controlling each configuration of the image forming apparatus 100. In particular, the controller 10 controls the operations of the operation section 2, the toner replenishing section 5, and the first image forming unit 62Y to the fourth image forming unit 62K including their respective image forming sections 6. Further, the controller 10 functions as an execution unit 101, a measurement unit 102, and a prediction unit 103 by executing the computer program stored in the storage 11.

The execution unit 101 controls the execution of the developer refresh operation when degradation of the toner is detected in any of the image forming units (for example, the first image forming unit 62Y; the specific image forming unit) of the first image forming unit 62Y to the fourth image forming unit 62K. The developer refresh means that the toner is ejected from the development roller 641 to the photosensitive drum 65 so that the toner replenishing section 5 replenishes the development device 64 with the toner. The developer refresh realizes the replacement of the toner in the developer container 640. If an electrostatic latent image corresponding to a solid image is formed on the surface of the photosensitive drum 65 with the toner not transferred to the sheet P, the developer refresh is efficiently executed. The toner supplied to the photosensitive drum 65 is removed by the cleaning device 66. Note that the degradation of the toner is detected, for example in the process of calibrating the bias voltage of the development power supply section 648.

The measurement section 102 measures respective surface potentials of the photosensitive drums 65 of the second image forming unit 62C to the fourth image forming unit 62K while the first image forming unit 62Y is executing the developer refreshing operation. For example, the measurement section 102 can employ, as a surface potential of each of the photosensitive drums 65, the DC component of the bias voltage of the development power supply section 648 when no direct current flows between a corresponding development roller 641 and a corresponding photosensitive drum 65.

In the first image forming unit 62Y, the surface potential of the photosensitive drum 65 has not been measured. Therefore, the prediction section 103 uses the measurement results of the respective surface potentials of the photosensitive drums 65 included in the second image forming unit 62C to the fourth image forming unit 62K for the prediction of the surface potential of the photosensitive drum 65 included in the first image forming unit 62Y. The prediction section 103 may further use a history of surface potentials of any one or more photosensitive drums 65 of the first image forming unit 62Y to the fourth image forming unit 62K for the prediction of the surface potential of the photosensitive drum 65 included in the first image forming unit 62Y.

Figure 4:
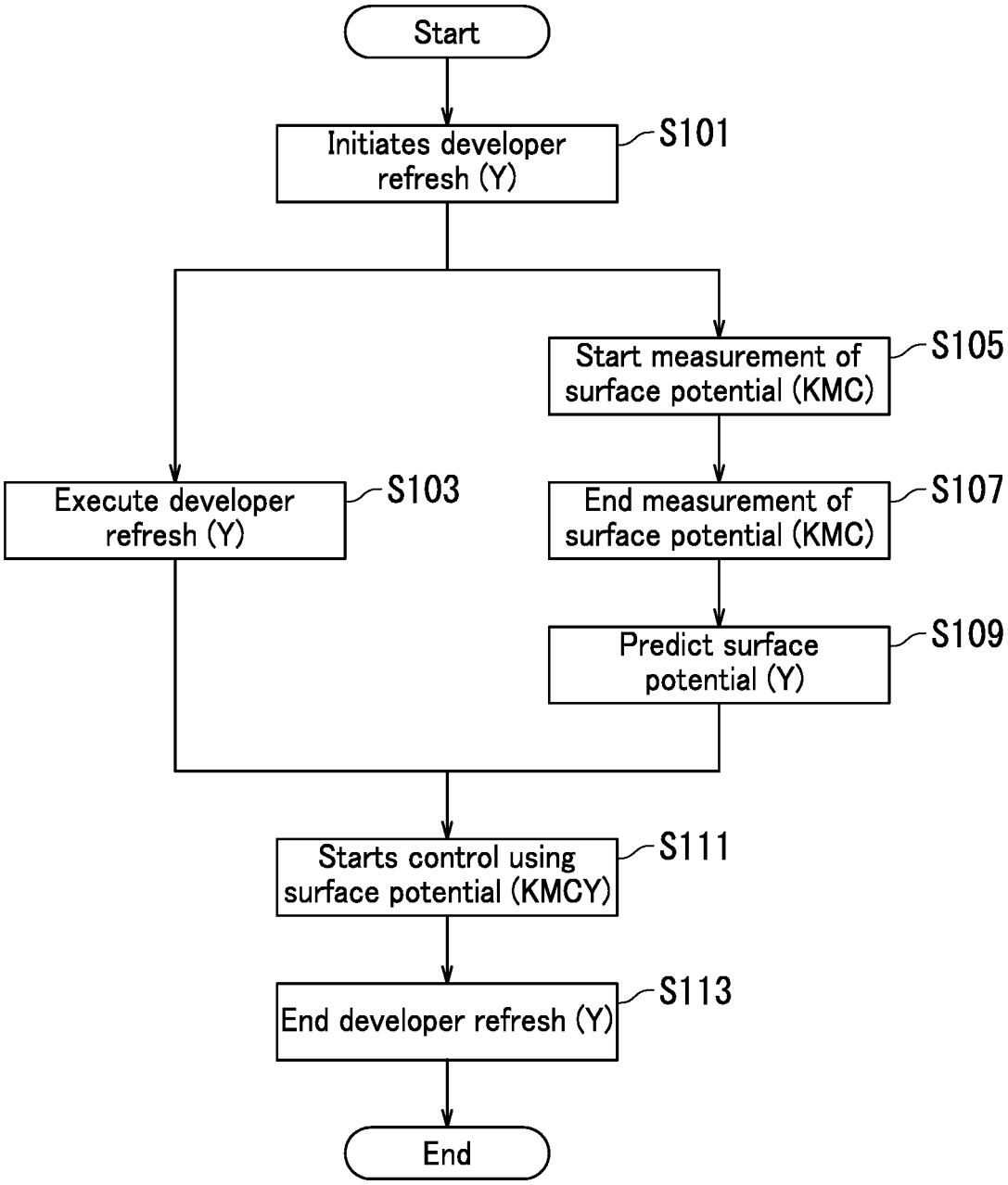
FIG. 4 is a flowchart illustrating an example of a process of a controller.

Next, the processing of the controller 10 will be described with reference to FIGS. 1 to 4. FIG. 4 is a flowchart illustrating an example of the processing of the controller 10. Here, it is assumed that the developer refresh is executed in the first image forming unit 62Y.

Step S101: as illustrated in FIG. 4, the controller 10 initiates a developer refresh in the first image forming unit 62Y. The process of the controller 10 then proceeds to Step S103 and Step S105.

Step S103: the controller 10 controls the execution of the developer refresh operation in the first image forming unit 62Y.

Step S105: the controller 10 starts measurement of respective surface potentials of the photosensitive drums 65 included in the second image forming unit 62C to the fourth image forming unit 62K in parallel with the action of Step S103.

Step S107: The controller 10 ends the measurement of respective surface potentials after obtaining the information on the respective surface potentials of the photosensitive drums 65 included in the second image forming unit 62C to the fourth image forming unit 62K. The process of the controller 10 then proceeds to Step S109.

Step S109: the controller 10 predicts the surface potential of the photosensitive drum 65 included in the first image forming unit 62Y while using the measurement results in Steps S105 to S107. The process of the controller 10 then proceeds to Step S111.

Step S11: the controller 10 starts control using the information of the surface potential of the photosensitive drums 65 in the first image forming unit 62Y to the fourth image forming unit 62K. For example, the information on the surface potential of the photosensitive drums 65 is used for the condition change of the charging device 63, the prediction of the degradation state of the charging device 63, or the prediction of the degradation state of the photosensitive drum 65. The process of the controller 10 then proceeds to Step S113.

Step S113: the controller 10 ends the developer refresh in the first image forming unit 62Y. When the action of Step S113 is completed, the process of the controller 10 ends.

Figures 5, 6:
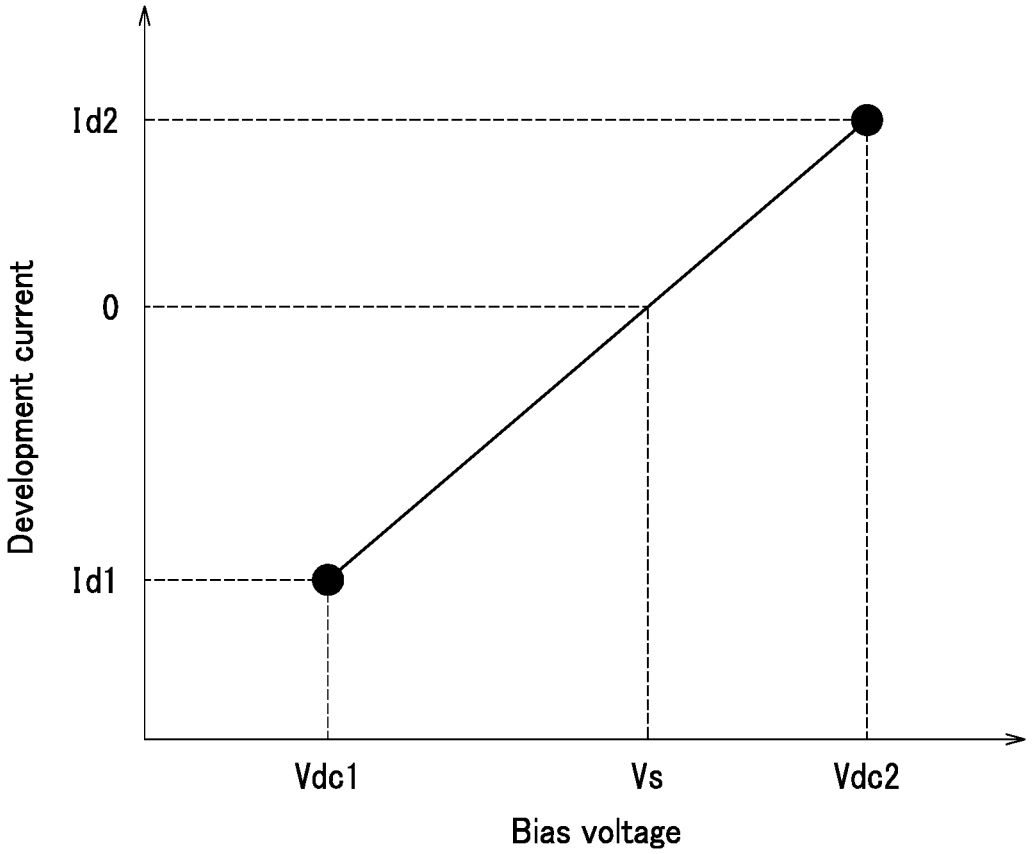
FIG. 5 illustrates an example of a method for obtaining information on a surface potential of an image bearing member.
FIG. 6 illustrates a method of predicting the surface potential of the image bearing member included in a specific image forming unit that has executed a developer refresh operation.

Next, a method of obtaining information on the surface potential of the photosensitive drum 65 will be described with reference to FIGS. 1 to 5. FIG. 5 illustrates an example of the method for obtaining information on the surface potential of the photosensitive drum 65. In FIG. 5, the horizontal axis depicts the DC component of the bias voltage of the development power supply section 648, and the vertical axis depicts the DC component of the development current.

As illustrated in FIG. 5, the development power supply section 648 applies, for example a first bias voltage Vdc1 across the development roller 641. At this time, the current measuring section 646 measures a first development current Id1 with a negative value. The controller 10 acquires information on the first bias voltage Vdc1 applied by the development power supply section 648 and the first development current Id1 measured with the current measuring section 646.

The development power supply section 648 also applies a second bias voltage Vdc2 across the development roller 641. At this time, the current measuring section 646 measures a second development current 1*d*2 with a positive value. The controller 10 acquires information on the second bias voltage Vdc2 applied by the development power supply section 648 and the second development current Id2 measured with the current measuring section 646.

The controller 10 determines the surface potential of the photosensitive drum 65 based on the acquired information on the first bias voltage Vdc1 and the first development current Id1 and the acquired information on the second bias voltage Vdc2 and the second development current Id2. For example, the controller 10 employs, as the surface potential of the photosensitive drum 65, the DC component Vs of the bias voltage of the development power supply section 648 when no DC current flows between the development roller 641 and the photosensitive drum 65.

Next, a method of predicting the surface potential will be described with reference to FIGS. 1 to 6. FIG. 6 illustrates a method of predicting the surface potential of the photosensitive drum 65 of the first image forming unit 62Y which has executed the developer refreshing operation.

FIG. 6 depicts the measurement results of respective surface potentials of the photosensitive drums 65 included in the second image forming unit 62C, the third image forming unit 62M, and the fourth image forming unit 62K at the time when printing on 27K sheets of paper P is completed. FIG. 6 depicts a history of respective surface potentials of the photosensitive drums 65 included in the first image forming unit 62Y to the fourth image forming unit 62K.

As depicted in FIG. 6, at the time of 27K sheets, the measurement result of the surface potential of the photosensitive drum 65 included in the second image forming unit 62C is 233V. At the time, the measurement result of the surface potential of the photosensitive drum 65 included in the third image forming unit 62M is 230V. At the time, the measurement result of the surface potential of the photosensitive drum 65 included in the fourth image forming unit 62K is 230V. The average value (KCM average value) of the three measurement results is 231.0V. Therefore, the surface potential of the photosensitive drum 65 included in the first image forming unit 62Y that has executed the developer refreshing operation is predicted to be, for example 231.0 V that is consistent with the KCM average value.

As depicted in FIG. 6, the KCM average value was 230.7V at the time of 20K sheets. Further, at the time of 20K sheets, the surface potential of the photosensitive drum 65 included in the first image forming unit 62Y was 232V, and the ratio to the KCM average value (=230.7V) was 1.00563. Therefore, the surface potential of the photosensitive drum 65 included in the first image forming unit 62Y that has executed the developer refreshing operation may be predicted to be, for example 232.3V obtained by multiplying the predicted value 231.0 V by the ratio so as to improve the prediction accuracy.

The embodiment provides an image forming apparatus 100 capable of obtaining information on a surface potential of a photosensitive drum 65 while suppressing a decrease in productivity.

An Embodiment of the present disclosure has been described above with reference to the accompanying drawings. However, the present disclosure is not limited to the above-described embodiment, and may be implemented in various aspects without departing from the gist thereof. In addition, various aspects may be created by appropriately combining the plurality of components disclosed in the above-described embodiment. For example, some components of all the components illustrated in the embodiment may be removed. The drawings schematically illustrate each component as a main body in order to make it easier to understand. The number and the like of illustrated components may differ from the actual ones for the convenience of the drawing. Further, each component illustrated in the above embodiment is an example and not particularly limited, and various modifications may be made without substantially deviating from the effects of the present disclosure.

For example, in the embodiment, the measurement section 102 employs, as the surface potential of the photosensitive drum 65, the DC component of the bias voltage of the development power supply section 648 when no DC current flows between the development roller 641 and the photosensitive drum 65. However, the present disclosure is not limited to this. In an example, the measurement section 102 sets, to a target current, a DC component of a development current w % ben the development roller 641 is supplied with only the AC component of the bias voltage with the DC component of the bias voltage of the development power supply section 648 set to 0V in a state where the surface potential of the photosensitive drum 65 is set to 0V. Subsequently, the measurement section 102 sets the surface potential of the photosensitive drum 65 to a desired value, and employs, as the surface potential of the photosensitive drum 65, the DC component of the bias voltage when the development current flowing when the DC component of the bias voltage is varied equals the target current.

What is claimed is:

1. An image forming apparatus, comprising:

a plurality of image forming units;

a toner replenishing section that replenishes each of the plurality of image forming units with toner; and a controller that controls an operation of the toner replenishing section and the plurality of image forming units, wherein each of the plurality of image forming units includes:

an image bearing member that bears an electrostatic latent image:

a development device that includes a developer bearing member that bears a developer containing the toner, and attaches the toner to the electrostatic latent image borne on the image bearing member to form a toner image:

a development power supply section that applies a bias voltage across the developer bearing member, wherein the controller includes:

an execution section that controls execution of a developer refresh operation in which the toner is ejected from the developer bearing member to the image bearing member so that a specific image forming unit of the plurality of image forming units replenishes the development device with the toner from the developer bearing member;

a measurement section that measures respective surface potentials of the image bearing members included in other image forming units other than the specific image forming unit of the plurality of image forming units while the specific image forming unit is executing the developer refresh operation; and a prediction section that uses measurement results of the respective surface potentials of the image bearing members included in the other image forming units for a prediction on the surface potential of the image bearing member included in the specific image forming unit.

2. The image forming apparatus according to claim 1, wherein the measurement section employs, as the surface potential of the image bearing member, a DC component of the bias voltage when no direct current flows between the developer bearing member and the image bearing member.

3. The image forming apparatus according to claim 1, wherein the prediction section further uses a history of the surface potential of the image bearing member included in any of the plurality of image forming units for the prediction of the surface potential of the image bearing member included in the specific image forming unit.

* * * * *